US007090079B2

(12) United States Patent
Ehrlund

(10) Patent No.: US 7,090,079 B2
(45) Date of Patent: Aug. 15, 2006

(54) CHILD RESISTANT PACKAGE WITH SLIDABLE TRAY SECTION

(75) Inventor: Ake Ehrlund, Spånga (SE)

(73) Assignee: Stora Enso AB, Falun (SE)

( * ) Notice: Subject to any disclaimer, the term of this patent is extended or adjusted under 35 U.S.C. 154(b) by 428 days.

(21) Appl. No.: 10/416,038

(22) PCT Filed: Nov. 9, 2001

(86) PCT No.: PCT/SE01/02496

§ 371 (c)(1),
(2), (4) Date: Oct. 16, 2003

(87) PCT Pub. No.: WO02/38454

PCT Pub. Date: May 16, 2002

(65) Prior Publication Data

US 2004/0050748 A1 Mar. 18, 2004

(30) Foreign Application Priority Data

Nov. 10, 2000 (SE) ..... 0004120

(51) Int. Cl.
*B65D 83/04* (2006.01)

(52) U.S. Cl. ..... 206/531; 206/1.5; 206/536; 206/539; 229/125.125

(58) Field of Classification Search ..... 206/528–539, 206/1.5; 229/125.125
See application file for complete search history.

(56) References Cited

U.S. PATENT DOCUMENTS 2,866,541 A * 12/1958 Ravis ..... 206/313
3,648,918 A * 3/1972 Van Inwagen ..... 229/125.125
3,743,084 A * 7/1973 Douglas ..... 206/532
4,120,400 A 10/1978 Kotyuk
4,401,210 A * 8/1983 Anjou ..... 206/1.5
4,848,582 A 7/1989 Levasseur et al.
5,080,222 A * 1/1992 McNary ..... 206/1.5
5,275,291 A * 1/1994 Sledge ..... 206/531
5,421,452 A 6/1995 Hybiske
6,032,795 A * 3/2000 Ehrlund et al. ..... 206/312
6,230,893 B1 * 5/2001 Karow ..... 206/531

FOREIGN PATENT DOCUMENTS

| | | |
|---|---|---|
| EP | 0 031 547 | 7/1981 |
| EP | 1 002 744 | 5/2000 |
| FR | 2 649 672 | 1/1991 |
| SE | 509 466 | 10/1997 |

* cited by examiner

*Primary Examiner*—Jila M. Mohandesi
(74) *Attorney, Agent, or Firm*—Young & Thompson

(57) ABSTRACT

A package made of cardboard, includes a sleeve and an insert, the sleeve being provided with at least one catch tab located on the inside of the sleeve and provided with at least one projection, so that the catch tab forms an angle with the upper wall of the sleeve. At least one locking tab is provided on the insert, which is arranged so as to be at least in part inserted between the catch tab and the upper wall. At least one operating tab is provided, in addition to which the sleeve is provided with at least one cutout next to the operating tab, the operating tab being arranged so as to be pressed by a user against the locking tab, movement of the insert in the sliding direction (S) towards the opening being made possible.

13 Claims, 5 Drawing Sheets

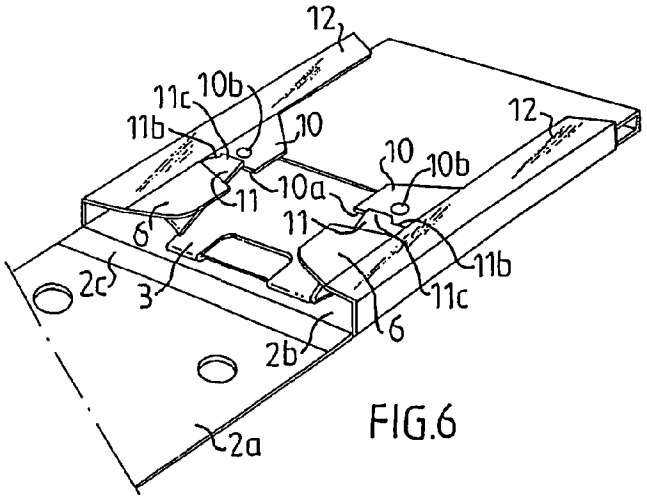
FIG.6
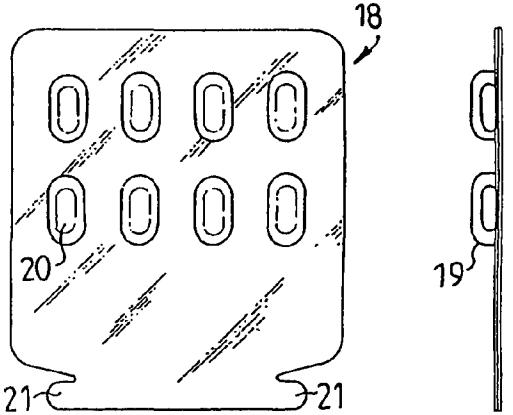
FIG.7
FIG.8
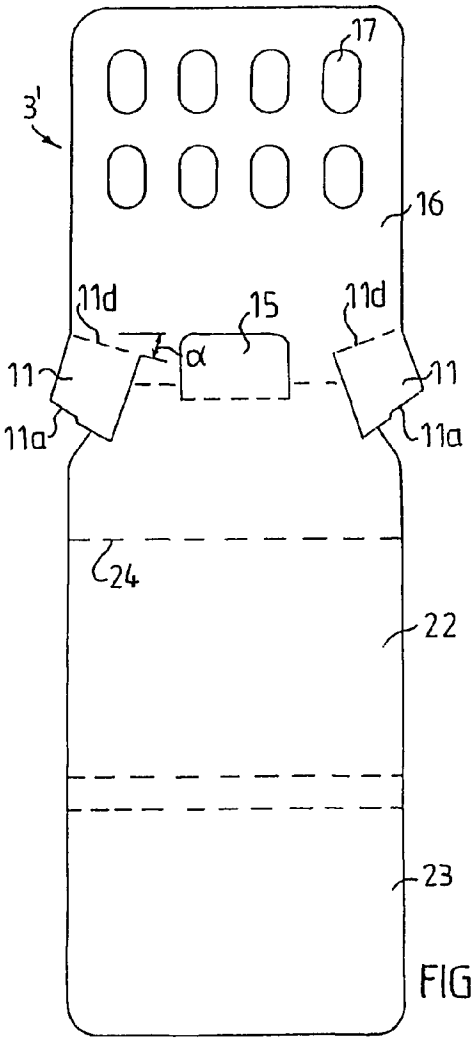
FIG.5
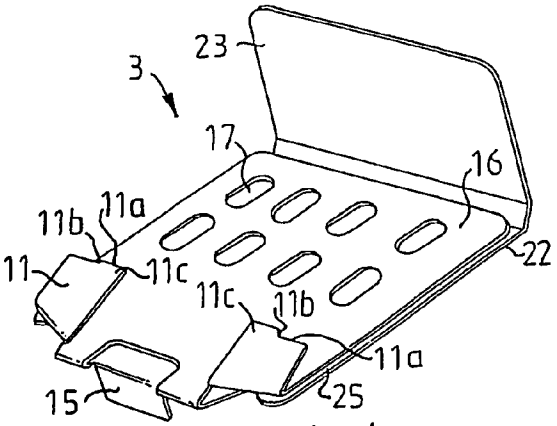
FIG.4
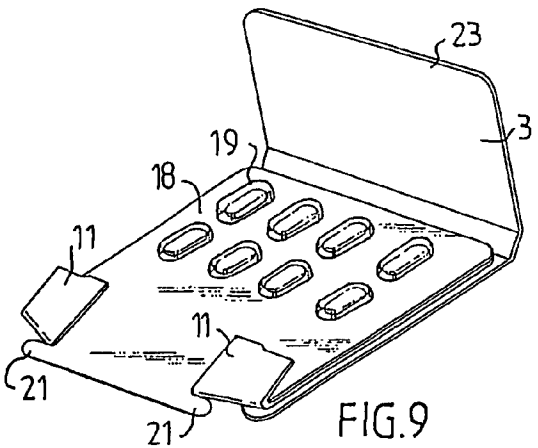
FIG.9

CHILD RESISTANT PACKAGE WITH SLIDABLE TRAY SECTION

TECHNICAL FIELD

The present invention relates to a package according to the precharacterizing clause of Patent claim 1.

BACKGROUND OF THE INVENTION

In packages for products, the contents of which may be dangerous for small children, it is desirable that the packages are designed so that the risk of small children opening them, in the event that they fall into their hands, is reduced.

EP 0 031 547 A1 describes a package, for example for pharmaceutical preparations, with a storage part and a lid which is displaceable on the storage part. Tabs form catches which prevent a relative movement between the storage part and the lid. The tabs can be folded aside, after which the lid can be pushed aside on the storage part. A disadvantage of the package in EP 0 031 547 A1 is that it does not afford adequate protection against small children gaining access to the contents. One reason for this is that the tabs are visible, which makes unlocking easier. Moreover the package can be opened easily after the tabs have been folded aside, if they are not subsequently actively folded back into the locking position again.

EP 1 002 744 A1 describes a cardboard package with a locking system for children, with an outer casing and an inner sliding part. The sliding part is prevented from being drawn out of the casing if a locking system has not been inactivated by pressing on a release button. The locking system functions by virtue of a tab on the sliding part coming into contact with a shoulder on the inside of the casing. The shoulder is formed by virtue of an inner cardboard ply, glued to an outer ply, being provided with a cutout. A disadvantage of this construction is that, for the locking system to function, it relies on the shoulder having sufficient height by virtue of the thickness of the inner cardboard ply. The locking function is thus made dependent on the selection of a sufficiently thick material for the casing. A material which is too thin can result in the locking security being put at risk. Moreover, it is likely that the construction will lead to the shoulder being worn down on repeated use, and that its function is impaired after a number of openings of the package.

One object of the present invention is to produce a package, for example for pharmaceutical preparations, in which the contents are better protected against children gaining access than in packages according to the known art.

Another object of the present invention is to produce a package, for example for pharmaceutical preparations, which has protection against children gaining access which is as good after repeated openings and closings as on the first opening.

A further object of the present invention is to produce a package, for example for pharmaceutical preparations, which is easier, and therefore less expensive, to manufacture than such packages according to the known art.

BRIEF DESCRIPTION

The objects mentioned above are achieved according to the invention by a package with the characterizing features in Patent Claim 1.

As a projection on the catch tab brings about an angle between the latter and the sleeve wall, and a locking tab interacting with the catch tab is at least in part arranged so as to be inserted between the catch tab and the upper wall, secure locking is ensured even if a thin cardboard material is used. Moreover, locking which can withstand wear on repeated use is brought about.

The package preferably comprises two catch tabs, two locking tabs, two operating tabs and two cutouts, the result of which is that the insert cannot be drawn out of the sleeve without the locks being inactivated by simultaneous pressing with two fingers. The advantage of this is that it is made more difficult for children to open the package.

Preferably, the sleeve comprises, at two glued tabs, two respective glued joints, and the insert has no glued joints, which means that the package is easy to manufacture.

DESCRIPTION OF THE FIGURES

The invention will now be described in greater detail with reference to the drawings, in which FIG. 4 shows a perspective view of a partly finished part of the package in FIG. 1, FIG. 5 shows a plan view of a manufacturing blank for the part in FIG. 4, FIG. 6 shows a perspective view of the package in FIG. 1, in a partly opened state for the sake of comprehension, FIG. 7 shows a plan view of a part of the package in FIG. 1, according to an embodiment of the invention, FIG. 8 shows a side view of the part in FIG. 7, FIG. 9 shows a perspective view of the part in FIG. 4 and the part in FIG. 7.

DETAILED DESCRIPTION

Figure 1:
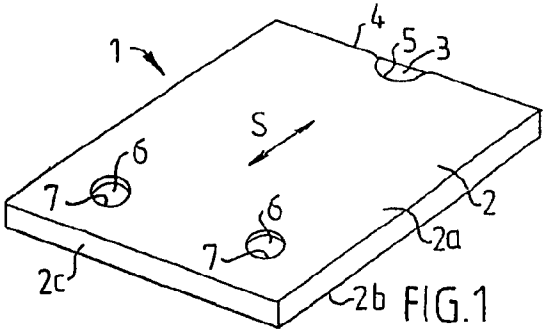
FIG. 1 shows a perspective view of a package according to an embodiment of the invention.

FIG. 1 shows a package 1 for products, for example pharmaceutical preparations in tablet form, consisting of an outer sleeve 2 which surrounds an insert 3 for the tablets. The sleeve 2 and the insert 3 are formed by folding over and, if appropriate, gluing sheets of cardboard. The sleeve 2 comprises an upper wall 2*a*, a lower wall 2*b*, side walls and a rear wall 2*c*.

The insert 3 can be inserted and withdrawn through an opening 4 (concealed in FIG. 1) in the sleeve 2. The sliding direction of the insert 3 is indicated by the double arrow S in FIG. 1. FIG. 1 shows the package 1 with the insert 3 in its inserted position, only a part of it being visible at an indentation 5, at which the insert 3 can be taken hold of for drawing out. Two locks, described in greater detail below, mean that the insert 3 cannot be drawn out of the sleeve 2 without the locks being inactivated by simultaneous pressing with two fingers, one on each of two operating tabs 6, each inside one of two cutouts 7 in the sleeve 2. Alternatively, the package 1 can be provided with only one lock, operated with one finger on one operating tab 6 through one cutout 7. The advantage of the arrangement which calls for two simultaneous pressing actions is that it affords improved security against children gaining access to the contents. The cutouts 7 can be provided with covers which are produced together with the cutouts 7, for example by perforation or cutting the upper wall 2*a*.

Figure 2:
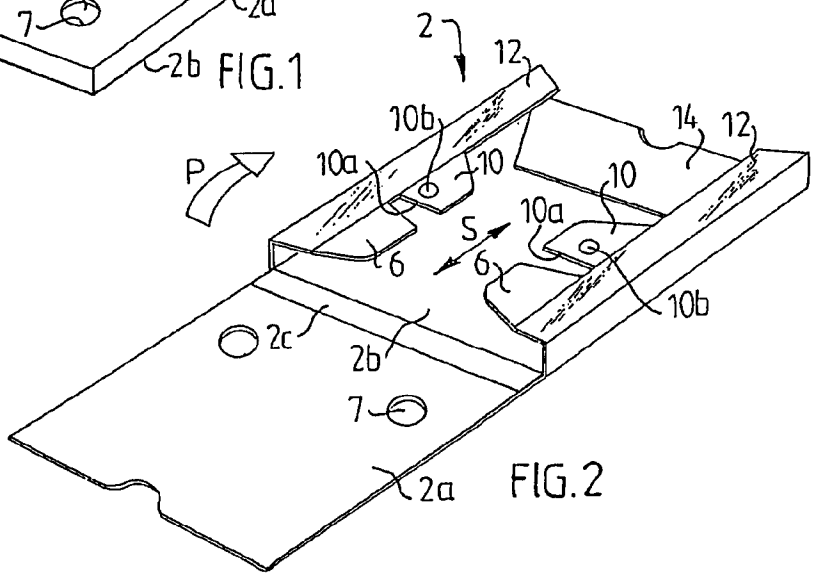
FIG. 2 shows a perspective view of a partly finished part of the package in FIG. 1.

FIG. 2 shows the sleeve partly folded. The sleeve is formed by folding and gluing a sleeve blank 2', shown in FIG. 3. The sleeve 2 in FIG. 2 is completed by the upper wall 2*a* being folded in over the rest of the sleeve blank, illustrated by the arrow P. The upper wall 2*a* is applied against two glued tabs 12 and is secured against these by glue.

The sleeve 2 is provided with two catch tabs 10, which are located on the inside of the sleeve in the folded-together state of the sleeve 2, at the upper wall 2*a*. Each catch tab 10 extends essentially transversely to the sliding direction S between an end at which it is connected to the sleeve 2 and a free end. Each catch tab 10 has a contact edge 10*a*, facing the rear wall 2*c*, and is provided with a projection 10*b*, shaped like a boss 10*b*, which extends essentially at right angles to the plane of the catch tab, and, in the folded-together state of the sleeve, towards the upper wall 2*a*. Alternatively, more than one projection 10*b* can be provided on each catch tab 10, or the projection(s) 10*b* can be designed as ridges, or with another suitable shape. The projections 10*b* can be formed by, for example, stamping the cardboard material. The boss 10*b* bears against the upper wall 2*a* so that, in the folded-together state of the sleeve, the catch tab 10 forms an angle with the upper wall 2*a*.

As an alternative, it is possible for the catch tab, or each catch tab 10, to extend in the sliding direction S between an end at which it is connected to the sleeve 2 and a free end.

Figure 3:
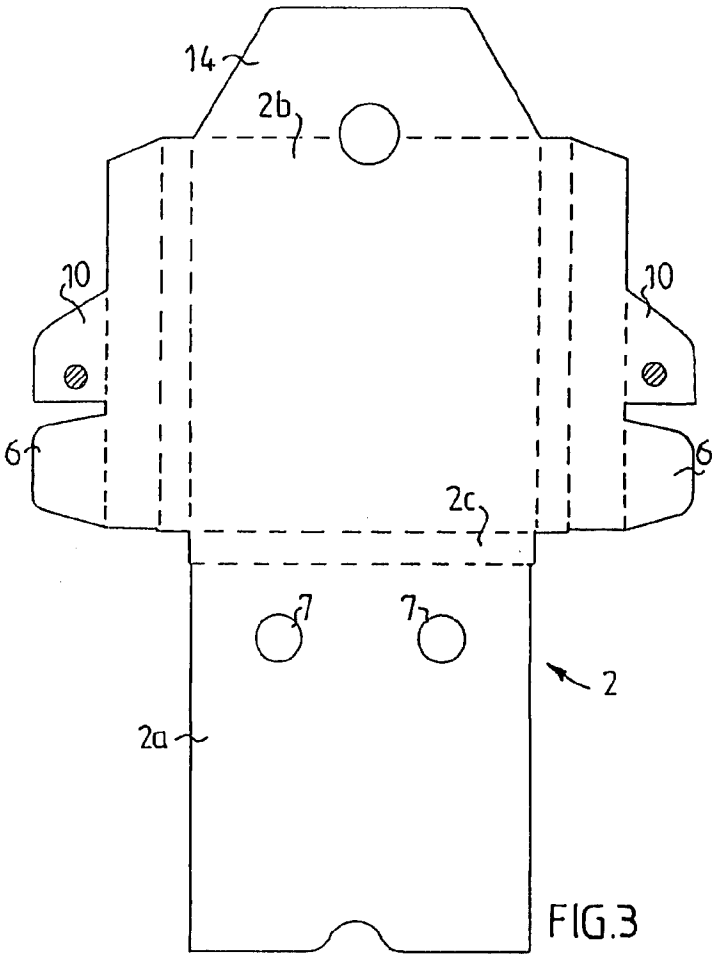
FIG. 3 shows a plan view of a manufacturing blank for the part in FIG. 2.

As can be seen from FIGS. 2 and 3, the sleeve 2 includes only two glued joints, which means the sleeve is easy to manufacture.

FIG. 4 shows the insert 3 partly folded. This is formed from an insert blank 3', shown in FIG. 5. For interaction with the catch tabs 10, two locking tabs 11 are provided, which, as shown in FIG. 4, are formed by folding a part of the insert blank 3'. Each locking tab 11 has a free edge 11*a* with a notch 11*b*. An engagement tab 11*c* is located on one side of the notch 11*b*.

FIG. 6 shows the insert 3 positioned in the sleeve 2, in a position of engagement between the locking tabs 11 and the catch tabs 10. For the sake of comprehension, the sleeve is shown open, with the upper wall 2*a* unfolded. However, as described above with reference to FIG. 2, the upper wall 2*a* serves a function in that, when attached to the glued tabs 12, it causes the catch tabs 10 to adopt a slightly downwardly angled position in relation to the upper wall 2*a*, by virtue of the bosses 10*b* bearing against the upper wall 2*a*. In the inserted position of the insert 3, and in a locking position of the locking tab 11, the free edge 11*a* is, in relation to an area where the locking tab 11 is connected to the insert 3, located closer to the opening 4 of the sleeve 2, and closer to the upper wall 2*a*. Each locking tab 11 prevents movement of the insert 3 out of the sleeve 2 by means of engagement with the respective catch tab 10. The engagement takes place by virtue of the engagement tab 11*c* being inserted between the catch tab 10 and the upper wall 2*a*, the notch 11*b* coming into contact with the contact edge 10*a*. The unimpeded insertion of the engagement tab 11*c* is ensured by a spacing between the catch tab 10 and the upper wall 2*a* brought about by the boss 10*b*.

As an alternative, it is possible for the locking tab 11 to have no notch 11*b* or engagement tab 11*c*, the entire locking tab 11, or a part of this closest to the free edge 11*a*, being intended to be inserted between the catch tab 10 and the upper wall 2*a* to lock the insert 3 in the sleeve 2.

As can be seen from FIG. 4, each locking tab is folded up towards the top side of the insert 3, so that the free edge 11*a* faces the other parts of the insert. Fold indications 11*d* are preferably provided for the locking tabs 11 in the insert blank 3' shown in FIG. 5. Each fold indication 11*d* preferably forms an angle $\alpha$, suitably around 18°, with the transverse direction of the insert blank. This means that, in the assembled state of the package, the free edge 11*a* forms an angle with the contact edge 10*a* on the catch tab 10. This ensures that the notch 11*b* on the locking tab 11 comes into contact with the contact edge 10*a*, because that side of the free edge 11*a* which is opposite the engagement tab 11*c*, and is located outside the notch, moves slightly in front of the notch 11*b* and is then guided under the catch tab 10 while the engagement tab is guided over the catch tab 10.

As can be seen from FIGS. 4 and 5, the insert 3 has no glued joints, which means that it is easy to manufacture.

FIG. 2 indicates that, in the folded-together state of the sleeve, the operating tabs 6 are located on the inside of the sleeve 2, at the upper wall 2*a*, between the catch tab 10 and the rear wall 2*c*. In the inserted state of the insert 3, each operating tab 6 is located between the upper wall 2*a* and the respective locking tab 11, the operating tab 6 extending essentially parallel to the upper wall 2*a*. The cutouts 7 provided on the sleeve 2 are, in the folded-together state of the sleeve, located next to the respective operating tabs 6, each operating tab 6 being arranged so as to be pressed with a finger through the respective cutout 7 against the respective locking tab 11, the latter adopting a clearance position. In this clearance position, the locking tab 11, seen in the sliding direction S of the insert 3, is located outside the area of extension of the catch tab 10 seen in the sliding direction S of the insert 3, which makes it possible to draw the insert 3 out of the sleeve 2 in the sliding direction S.

On pressing down, the locking tab 11 is resilient so that, when the pressure is removed, it tends to return to the locking position.

FIGS. 2 and 3 show a sleeve tab 14 on the sleeve 2, intended to be folded over towards the inside of the lower wall 2*b* and to appear at the opening 4 of the finished sleeve 2. FIGS. 4 and 5 show a stop tab 15 on the insert 3, which is intended to be folded over towards the underside of the insert 3. The sleeve tab 14 and the stop tab 15 are intended to prevent the insert 3 being drawn completely out of the sleeve 2 by virtue of the stop tab 15 moving in between the sleeve tab 14 and the lower wall 2*b* and in this way coming into engagement with the sleeve tab.

FIG. 5 shows that the insert preferably comprises an inner tab 16 with openings 17 for interaction with a blister pack 18, shown in FIGS. 7 and 8. According to the known art, the blister pack 18 comprises bubbles 19 made of a thin plastic material which is attached to a foil, the bubbles 19 being used for storing, for example, pharmaceutical preparation units 20 in the form of tablets or capsules.

The blister pack 18 preferably comprises two fixing tabs 21 for interaction with the locking tabs 11 in the manner shown in FIG. 9. The fixing tabs can be produced by punching the blister pack 18. The blister pack 18 is intended to be positioned in the insert 3 with the bubbles 19 facing upwards, the fixing tabs 21 being guided into engagement with the locking tabs 11, so that the blister pack 18 is fixed in relation to the insert 3. As described above, the fold indications 11*d* in the insert blank 3' shown in FIG. 5 form an angle α with the transverse direction of the insert blank. This simplifies assembly of the package. In this connection, the blister pack 18 is positioned on the insert blank 3', with the fixing tabs 21 next to the locking tabs 11. The locking tabs 11 are then folded up, the angle α causing the fixing tabs 21 to be folded up slightly by the locking tabs 11, subsequently to slide off these and return to their original position. This arrangement means that the blister pack 18 can be arranged with ease in the insert 3 by means of mechanical equipment.

Reference is now made to FIGS. 4 and 5. The insert comprises a bottom 22 and an upper tab 23. When the insert 3 is inserted into the sleeve 2, the inner tab 16 is folded over the bottom 22, and the upper tab 23 is folded over the inner tab 16. When the insert is drawn out so that the stop tab 15 is in engagement with the sleeve tab 14, the upper tab 23 can be folded up so that the bubbles 19 are exposed, see FIG. 9. The fold indication marked by a broken line 24 in FIG. 5 on the bottom 22 of the insert means that, in the drawn-out state of the insert, a part of the bottom 22 and the upper tab 23 can be folded down so that a pharmaceutical product unit 20 can be pressed out downwards through one of the openings 17 in the inner tab 16, the insert 3 being retained in the sleeve by the sleeve tab 14 and the stop tab 15.

The orientation of the locking tabs 11 means that, during reinsertion of the insert 3 into the sleeve 2, they can, on contact with the catch tabs 10, be inclined further towards the lower wall 2*b* so as to facilitate movement past the catch tabs 10.

FIG. 4 shows that the insert has a space between the inner tab 16 and the bottom 22, in which printed matter can be kept. This can be mechanically packed with ease.

As an alternative to cardboard, other suitable materials can be used for the package, for example plastic.

In an alternative embodiment, the package can be made without operating tabs 6, each of the locking tabs being accessible through a respective opening in the sleeve and being bringable into its respective locking position by being touched directly by a user. In this way, the construction of the package is simplified, which makes its manufacture simpler and less expensive.

Figure 10:
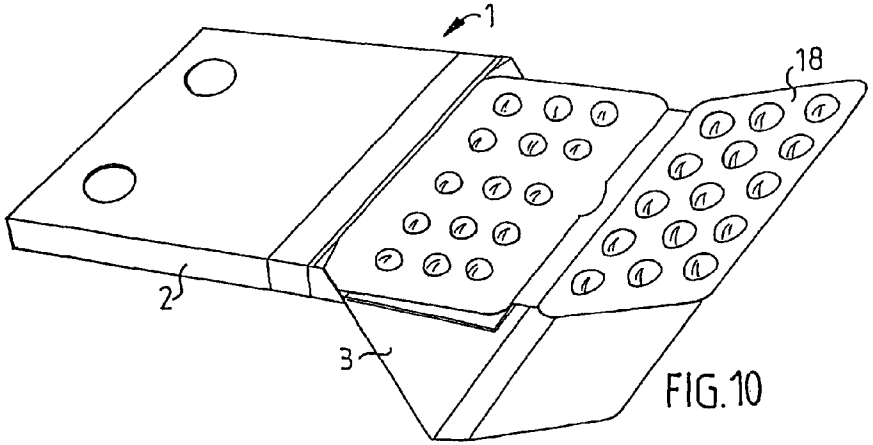
FIG. 10 shows a perspective view of a package according to a further embodiment of the invention.

FIG. 10 shows a package 1 according to a further alternative embodiment of the invention. In a similar manner to the package described above, this comprises a sleeve 2 and an insert 3 which is arranged so as to interact with a blister pack 18 described in greater detail below.

The sleeve in FIG. 10 can be of the same type as the sleeve forming part of the embodiment described above with reference to FIGS. 1–6. The sleeve and the blank for this are shown in FIGS. 2 and 3.

Figure 11:
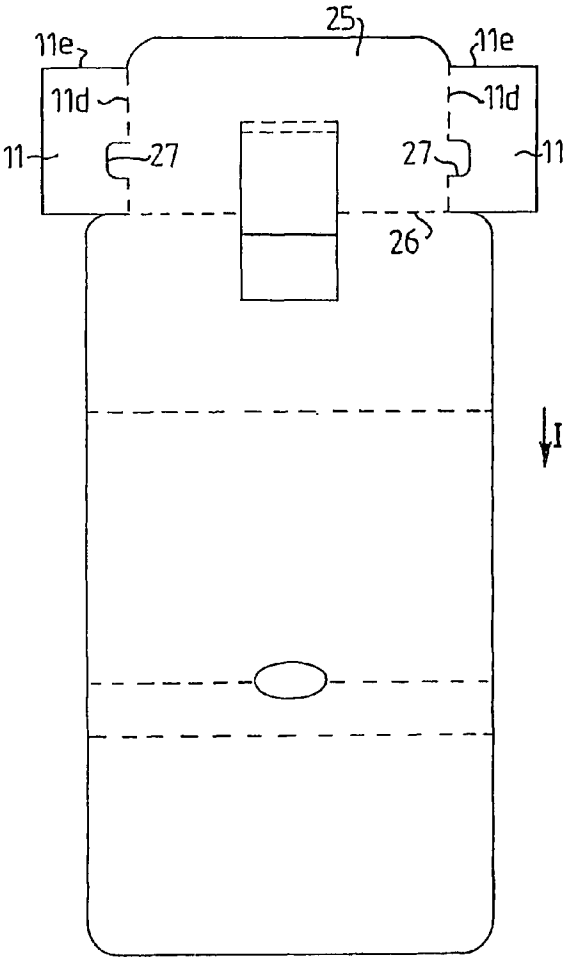
FIG. 11 shows a plan view of a manufacturing blank for a part of the package in FIG. 10.

FIG. 11 shows a manufacturing blank 3' for the insert in FIG. 10. For interaction with the catch tabs 10 on the sleeve, two locking tabs 11 are provided, which are formed by folding a part of the insert blank 3'. The arrow I shows the insertion direction when the insert in its folded state is inserted into the sleeve.

An area 25 in which the locking tabs are arranged is intended to be folded around an indication 26 towards the other parts of the insert. Fold indications 11*d* are provided in the insert blank 3' for the locking tabs 11. Each fold indication 11*d* is essentially parallel to the insertion direction I of the insert.

Figure 12:
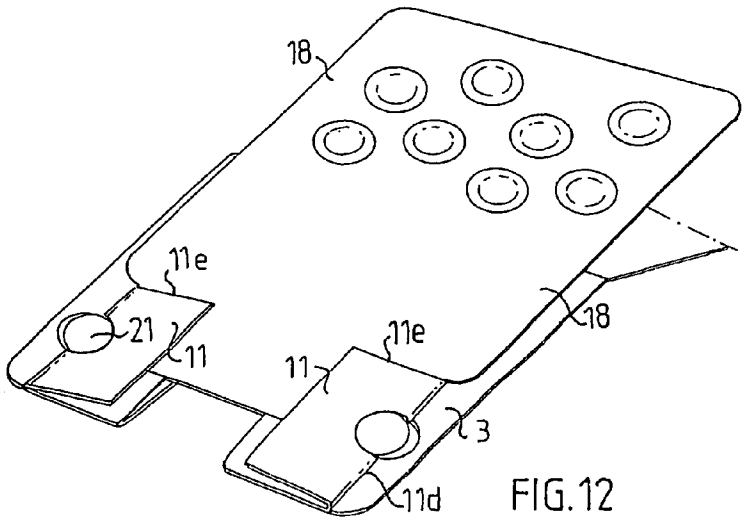
FIG. 12 shows a perspective view of parts of the package in FIG. 10.
Figure 13:
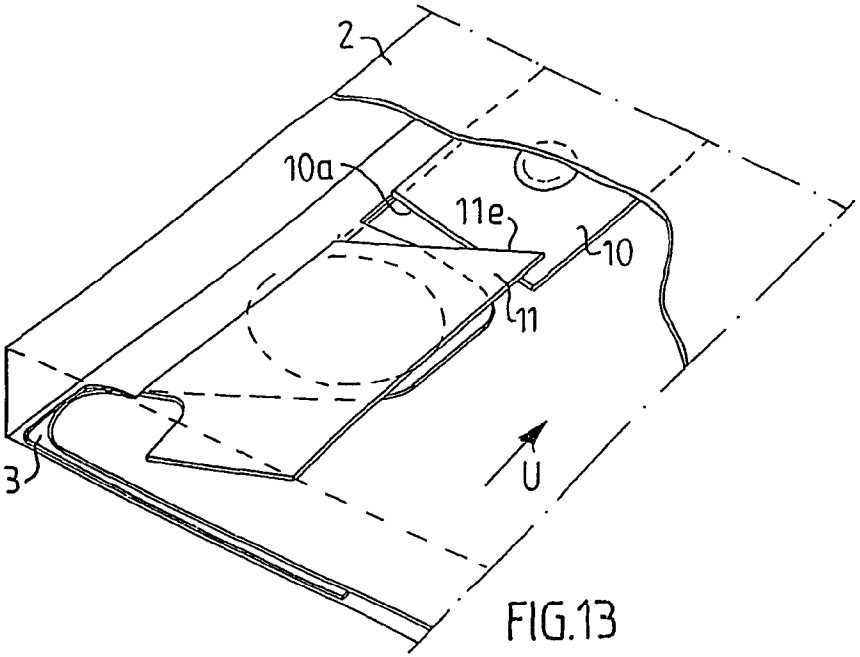
FIG. 13 shows a partly sectioned view of a part of the package in FIG. 10, FIGS. 14 and 15 show a plan view and, respectively, a side view of a part for the package in FIG. 10, and FIGS. 16–18 show perspective views of parts for a package according to yet another embodiment of the invention.

As can be seen in FIG. 12, the locking tabs 11 are intended to be folded around the fold indications 11*d*. A contact edge 11*e* on each of the locking tabs is intended to come into contact with a contact edge 10*a* on the respective catch tab 10 on the sleeve 2 (see FIG. 2). FIG. 13 shows diagrammatically how this happens. When the locking tab is in its locking position and an attempt is made to draw the insert 3 out of the sleeve 2, drawing-out is prevented, in a direction indicated by the arrow U, by virtue of the contact edge 11*e* of the locking tab 11 coming into contact with the contact edge 10*a* of the catch tab.

The folding of the locking tabs 11 parallel to the withdrawal direction U means that forces which arise when attempts are made to draw out the insert in the locking positions of the locking tabs are mainly transmitted in the plane of the locking tabs, which means that they have great strength and that the risk of the package being opened by force, for example by a child, is reduced.

In an alternative embodiment, the locking tabs are folded up directly from the other parts of the insert without a separate area 25 (FIG. 11) on which the locking tabs are located being folded in relation to the other parts of the insert.

As in the embodiment shown previously with reference to FIGS. 1–6, the sleeve in connection with the embodiment shown in FIGS. 10–13 can also be provided with operating tabs 6 (see FIG. 2), each operating tab 6 being located, in the inserted state of the insert 3, between the upper wall 2*a* and the respective locking tab 11, the operating tab 6 extending essentially parallel to the upper wall 2*a*. The cutouts 7 provided on the sleeve 2 are, in the folded-together state of the sleeve, located next to the respective operating tabs 6, each operating tab 6 being arranged so as to be pressed with a finger through the respective cutout 7 against the respective locking tab 11, the latter adopting a clearance position. In this clearance position, the locking tab 11, seen in the sliding direction S of the insert 3, is located outside the area of extension of the catch tab 10 seen in the sliding direction S of the insert 3, which makes it possible to draw the insert 3 out of the sleeve 2 in the sliding direction S.

On pressing down, the locking tab 11 is resilient so that, when the pressure is removed, it tends to return to the locking position.

Figure 14:
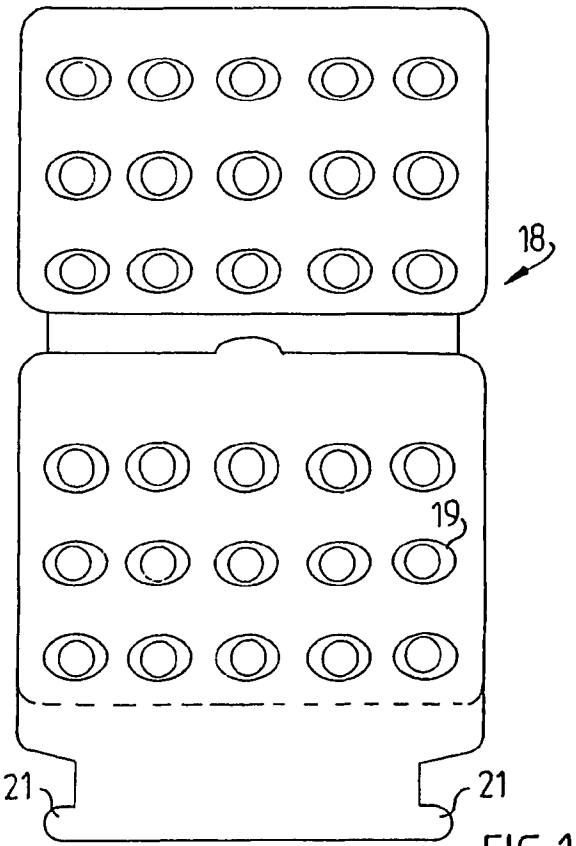
Figure 15:
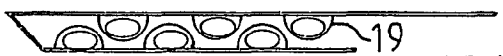

FIGS. 14 and 15 show an alternative embodiment of a blister pack 18, in which bubbles 19, each for containing a product, for example a pharmaceutical preparation tablet, are arranged so that the blister pack 18 can be folded together (FIG. 15), the bubbles being positioned between one another and being adapted so as, by means of mutual contact, to keep the blister pack 18 folded together by friction, which facilitates feeding of the same into the package by means of what is known as a suction cup arrangement in an automatic assembly machine.

The blister pack 18 preferably comprises two fixing tabs 21 for interaction with the locking tabs 11 in the manner shown in FIG. 12. To this end, the insert 3 is, as shown in FIG. 11, provided with cutouts 27 in the locking tabs.

Figure 18:
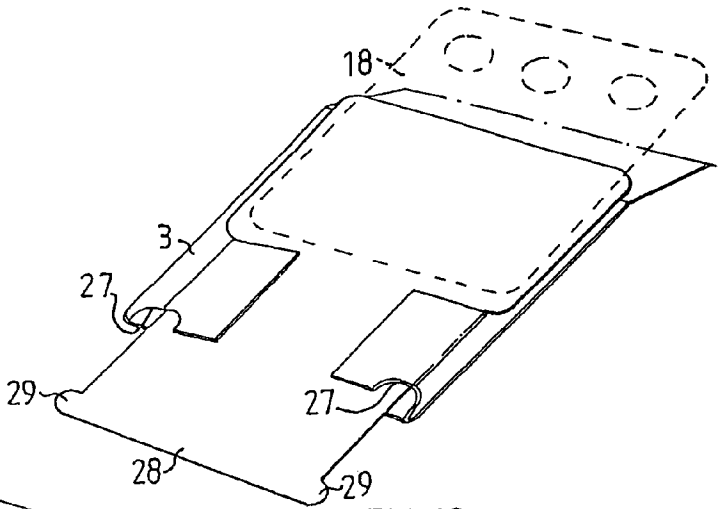
Figure 17:
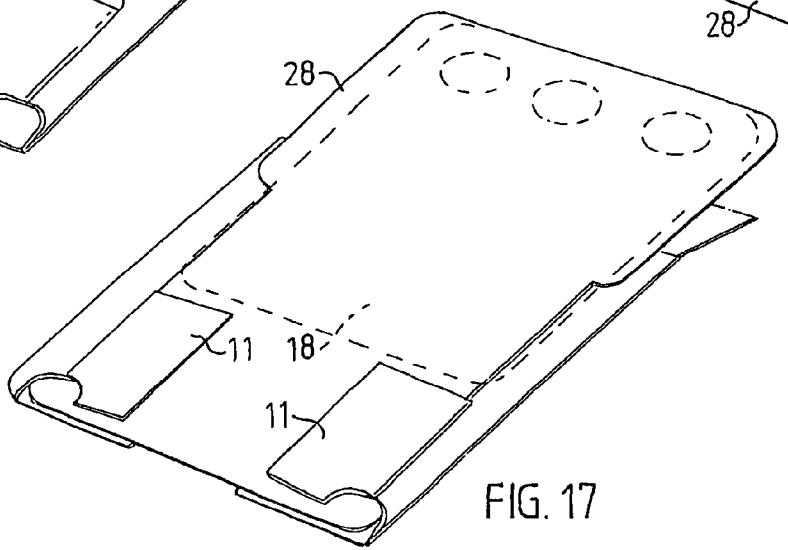
Figure 16:
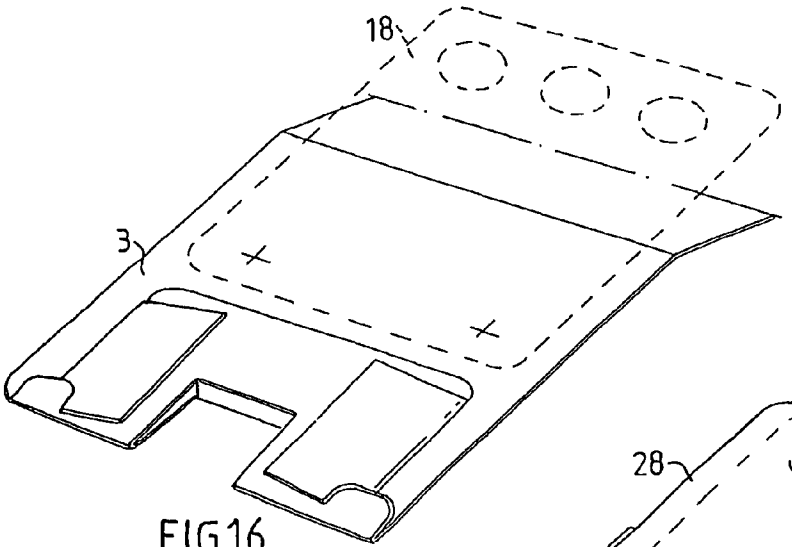

FIGS. 16–18 show a further embodiment of the package according to the invention. A product-carrying unit 18 (shown in broken lines in FIG. 16), such as a blister pack, is mounted on the insert 3 by gluing, taping, stapling or in another way. As shown in FIG. 17, an information-carrying unit 28 is located on top of the blister pack 18. The information-carrying unit, which may be a cardboard sheet with text, an information folder or a leaflet, is arranged so as to be located between two locking tabs 11 which are arranged in the same manner as in the example described above with reference to FIGS. 10–13. The information-carrying unit 28 is provided with lugs 29 (see FIG. 18) which are arranged so as to interact with the locking tabs 11 or cutouts 27 in these in order to prevent complete drawing-out of the information-carrying unit from the package. This is an advantage if the package contains a product with which information is to be supplied, and a better possibility is to be afforded that the information remains together with the product after the first opening of the product as well. A loose information sheet or the like can easily be removed from the package, in which case the information is not available for future use, which may be inappropriate, especially if a long time elapses between instances of use or there are different users.

As can be seen in FIG. 18, the information-carrying unit 28 is arranged so as, in the drawn-out position of the insert 3, to be pushed into the sleeve of the package in order to expose the blister pack 18. Such an arrangement means that the information-carrying unit 28 is shown to the user when the latter wishes to reach the product, after which it can be pushed into the sleeve in order to facilitate access to the product. The folding of the locking tabs 11 in the insertion direction of the insert 3 facilitates this. Alternatively, the blister pack 18 can be arranged so as to move in relation to the insert 3 in the same manner.

In a special embodiment, the cutouts 7 (see FIG. 1) in the sleeve are arranged at a distance from one another so that simultaneous pressing down of both locking tabs 11 is possible only for people who can move two fingers on the same hand sufficiently far apart from one another in order to reach both the cutouts 7 simultaneously. As the hands of children are usually smaller than the hands of adults, this means that the access of children to the product in the package is restricted in the event that they have understood the function of simultaneous pressing-down in the cutouts 7. However, the necessity of simultaneous operations being performed in two places on the package in order for the latter to be opened constitutes a considerable increase in the difficulty for small children of reaching the contents of the package. It is nevertheless possible that the package be provided with only one locking tab and one catch tab so that a coordinated operation is not required in order to draw the insert out.

The invention claimed is:

1. Package (1), comprising a sleeve (2) of essentially parallelepiped shape, the sleeve (2) comprising an upper wall (2*a*), a lower wall (2*b*), side walls and a rear wall (2*c*), and also an insert (3) formed from an insert blank (3'), which insert can be inserted into and withdrawn from the sleeve (2), in a sliding direction (S), through an opening (4) in the sleeve (2), characterized in that the sleeve (2) is provided with at least one catch tab (10) located on the inside of the sleeve, at the upper wall (2*a*), in addition to which the catch tab (10) is provided with at least one projection (10*b*) which extends essentially at right angles to the plane of the catch tab and towards the upper wall (2*a*), at least one of the projections (10*b*) bearing against the upper wall (2*a*) so that the catch tab (10) forms an angle with the upper wall (2*a*), for each of the catch tabs (10) a locking tab (11) is provided, which is formed by folding a part of the insert blank (3') and has a free edge (11*a*), the free edge (11*a*) being, in relation to an area where the locking tab (11) is connected to the insert 3, in the inserted position of the insert (3), and in a locking position of the locking tab (11), located closer to the upper wall (2*a*), in addition to which the locking tab (11) is arranged so as to prevent movement of the insert (3) out of the sleeve (2) by means of engagement with the catch tab (10), in addition to which the locking tab (11) is arranged so as to adopt a clearance position, in which it, projected in the sliding direction (S) of the insert (3), is located outside the area of extension of the catch tab (10) projected in the sliding direction (S) of the insert (3), movement of the insert (3) in the sliding direction (S) towards the opening (4) being made possible, in addition to which the locking tab (11) is, by spring action, subjected to a force directed towards the locking position.

2. Package according to claim 1, characterized in that the free edge (11*a*) is, in relation to an area where the locking tab (11) is connected to the insert (3), in the inserted position of the insert (3), and in a locking position of the locking tab (11), located closer to the opening (4) of the sleeve (2).

3. Package according to claim 1, characterized in that for each of the locking tabs (11) an operating tab (6) is provided, located on the inside of the sleeve, at the upper wall (2*a*), between the catch tab (10) and the rear wall (2*c*), and, in the inserted state of the insert, between the upper wall (2*a*) and the locking tab (11), the operating tab (6) extending essentially parallel to the upper wall (2*a*) between an end at which it is connected to the sleeve (2) and a free end, in addition to which the sleeve (2) is, for each of the operating tabs (6), for access of a user to the respective operating tab (6), provided with a cutout (7) in the upper wall (2*a*), next to the operating tab (6), the operating tab (6) being arranged so as to be pressed against the locking tab (11).

4. Package according to claim 1, the locking tab (11) or a part thereof being arranged so as to be inserted between the catch tab (10) and the upper wall (2*a*).

5. Package according to claim 1, the catch tab (10) extending essentially transversely to the sliding direction (S) between an end at which it is connected to the sleeve (2) and a free end.

6. Package according to claim 1, the catch tab (10) having a contact edge (10*a*) facing the rear wall (2*c*), in addition to which the locking tab (11) has, on the free edge (11*a*), a notch (11*b*) and an engagement tab (11*c*), located on one side of the notch (11*b*), the engagement tab (11*c*) being arranged so as to be inserted between the catch tab and the upper wall (2*a*), in addition to which the notch (11*b*) is arranged so as to come into contact with the contact edge (10*a*).

7. Package according to claim 1, a fold indication (11*d*) for each locking tab (11) being provided in the insert blank (3'), the fold indication (11*d*) forming an angle ($\alpha$) with the transverse direction of the insert blank (3').

8. Package according to claim 1, comprising two catch tabs (10), two locking tabs (11), two operating tabs (6) and two cutouts (7).

9. Package according to claim 1, comprising a blister pack (18) provided with two fixing tabs (21) in engagement with the locking tabs (11), 50 that the blister pack (18) is fixed in relation to the insert (3).

10. Package according to claim 1, the insert (3) having a space for keeping printed matter arranged between an inner tab (16) and a bottom (22).

11. Package according to claim 1, the sleeve (2) comprising, at two glued tabs (12), two respective glued joints, and the insert (3) having no glued joints.

12. Package according to claim 1, the insert (3) being provided with a stop tab (15) arranged so as to prevent the insert (3) being drawn completely out of the sleeve (2) by virtue of the stop tab (15) , when the insert (3) is drawn out, coming into engagement with a sleeve tab (14) located on the sleeve.

13. Package according to claim 1, the locking tab being arranged folded essentially parallel to the sliding direction (S) of the insert in the sleeve, and the engagement of the locking tab (11) with the catch tab (10) meaning that a contact edge (11*e*) on the locking tab comes into contact with a contact edge (10*a*) on the catch tab (10) in order to prevent movement of the insert out of the sleeve (2).

* * * * *